US005353046A

United States Patent [19]

Tanaka et al.

[11] Patent Number: 5,353,046

[45] Date of Patent: Oct. 4, 1994

[54] DIVISIONAL-TYPE THERMAL PRINTHEAD

[75] Inventors: Akihiro Tanaka; Teruhisa Sako; Yoshinobu Kishimoto, all of Kyoto, Japan

[73] Assignee: Rohm Co., Ltd., Kyoto, Japan

[21] Appl. No.: 46,748

[22] Filed: Apr. 15, 1993

[30] Foreign Application Priority Data

Apr. 17, 1992 [JP] Japan ..... 4-098287
Apr. 28, 1992 [JP] Japan ..... 4-110342

[51] Int. Cl.[5] ..... B61J 2/335; B61J 2/34; B61J 2/345

[52] U.S. Cl. ..... 346/76 PH

[58] Field of Search ..... 346/76 PH; 400/120

[56] References Cited

U.S. PATENT DOCUMENTS 5,028,935 7/1991 Warmack et al. ..... 346/76 PH

FOREIGN PATENT DOCUMENTS 0072967 3/1990 Japan ..... 346/76 PH
0212157 8/1990 Japan ..... 346/76 PH

*Primary Examiner*—Benjamin R. Fuller
*Assistant Examiner*—Huan Tran
*Attorney, Agent, or Firm*—William H. Eilberg

[57] ABSTRACT

A divisional-type thermal printhead comprises an elongate support member, and a crow of unit head substrates each fixed on the support member and carrying a resistor line extending longitudinally of the support member. A pair of V-shaped boundary spaces is formed between each two adjacent unit head substrates to extend transversely from the resistor line in opposite directions. A resin spacer is formed in each of the boundary spaces to prevent warping or bending of the printhead.

9 Claims, 9 Drawing Sheets

DIVISIONAL-TYPE THERMAL PRINTHEAD

BACKGROUND OF THE INVENTION

1. Field of the Invention

This invention relates generally to thermal printheads which are widely used in facsimile machines and various printers. More specifically, the present invention relates to a thermal printhead of the type which comprises a plurality of unit head substrates arranged in series on a common support member for providing an increased printing width.

2. Description of the Prior Art

As is well known, thermal printheads are widely used to print information on papers of various sizes. Thus, the length of the printhead (namely, the printing width) must be adjusted to suit the particular paper size to which the printhead is applied.

However, if the paper size is too large, it becomes difficult or impractical to increase the length of a single thermal printhead to suit the excessively large paper size such as JIS-A2 (JIS: Japanese Industrial Standard) or larger paper size. Further, it is technically disadvantageous to provide thermal heads of various sizes due to the necessity of redesigning upon every change in size.

In view of these problems, it has been proposed to use a thermal printhead of the type which comprises a plurality of unit head substrates arranged in series on a common support member. Such a printhead, called "divisional-type thermal printhead", enables optional adjustment of the overall printing width by selecting the number of unit head substrates without changing the length of each unit head substrate itself.

However, a prior art divisional-type thermal printhead still has certain problems. For conveniently explaining the problems of the prior art printhead, reference is now made to FIGS. 9 to 18 of the accompanying drawings.

As shown in FIGS. 9 to 14, the prior art divisional-type thermal printhead 10' comprises plural (three for example) unit head substrates 11', 12', 13' arranged in series commonly on an elongate metal support member 14'. The respective unit substrates may adhesively fixed to the support member.

Each of the unit substrates 11'–13' carries a resistor line 11*a'*, 12*a'*, 13*a'* extending longitudinally of the support member 14' to provide a line of heating dots. The unit substrate has a unit printing width S1', and the printhead 10' as a whole provides an overall printing width S'.

The inner end of the left-hand unit substrate 11' in FIG. 9 is formed with a pair of boundary edges 11*b'*, 11*c'* which extend from the corresponding resistor line 11*a'* and are inclined in opposite directions. Similarly, each end of the central unit substrate 12' is formed with a pair of boundary edges 12*b'*, 12*c'* which extend from the corresponding resistor line 12*a'* and are inclined in opposite direction. Further, similarly, the inner end of the right-hand unit substrate 13' is formed with a pair of boundary edges 13*b'*, 13*c'* which extend from the corresponding resistor line 11*a'* and are inclined in opposite directions. As a result, a pair of V-shaped boundary spaces 15*a'*, 15*b'* (see FIGS. 9, 10 and 12) are formed between the left-hand and central unit substrates 11', 12', whereas another pair of V-shaped boundary spaces 16*a'*, 16*b'* (FIG. 9) are formed between the central and right-hand unit substrates 12', 13'.

As shown in FIG. 10, the respective resistor lines 11*a'*–13*a'* are displaced transversely from each other by an amount E'. As a result the respective unit substrates 11'–13' can be brought toward each other to make each two adjacent resistor lines overlap each other by an amount W' to provide widthwise linear continuity for printing while still maintaining a minimum clearance T' (see also FIG. 10) of the micrometer order between the adjacent resistor lines.

As shown in FIGS. 15 to 18, the unit head substrates 11'–13' are flanked by respective pairs of connector circuit boards 17*a'*, 17*b'*, 18*a'*, 18*b'*, 19*a'*, 19*b'*. The pairs of connector circuit boards are held place on the support member 14' by respective pairs of presser covers 22*a'*, 22*b'*, 23*a'*, 23*b'*, 24*a'*, 24*b'*, which are in turn fixed to the support member 14' by respective screws 20', 21'. Though not specifically shown each of the connector circuit boards has a flexible film projecting beyond a backing plate to partially overlap the corresponding unit head substrate.

The respective pairs of presser covers 22*a'*, 22*b'*, 23*a'*, 23*b'*, 24*a'*, 24*b'*, protect arrays of drive ICs 25', 26' arranged on both sides of the resistor lines 11*a'*, 12*a'*, 13*a'*. Further, the pairs of presser covers also press the respective pairs of connector circuit boards 17*a'*, 17*b'*, 18*a'*, 18*b'*, 19*a'*, 19*b'* (specifically, the flexible films thereof) into intimate contact with the unit head substrates 11'–13' via respective rubber rods 27', 28'.

In operation of the prior art printhead 10', a platen 29' is pressed downwardly against the printhead in contact with the respectively resistor lines 11*a'*, 12*a'*, 13*a'*, as shown in FIG. 14. Due to such a pressing contact, the support member 14' tends to warp downwardly, as indicated by phantom lines in FIG. 13.

When the support member 14' warps downwardly, the inclined boundary edges 11*b'*, 11*c'*, 12*b'*, 12*c'*, 13*b'*, 13*c'* of the respective unit head substrates 11'–13' may be brought into mutual contact since the minimum clearance T' is initially very small. As a result, the respective unit head substrates may be damaged (e.g. chipping) at the boundary edges due to such contact, consequently causing a printing quality deterioration at the boundaries between the respective unit head substrates.

Further, in the prior art printhead, the respective boundaries A', B' between the successive presser covers 22*a'*, 22*b'*, 23*a'*, 23*b'*, 24*a'*, 24*b'* are made to coincide with the boundaries C' between the respective unit head substrates 11'–13' longitudinally of the support plate 14'. Thus, the printhead 10' is most easily bendable at locations where the three kinds of boundaries A', B', C' coincide.

When the platen 29' is pressed downwardly against the printhead 10' having the above-described presser cover assembly (see FIG. 16), the printhead tends to bend abruptly at the boundaries C' between the unit head substrates 11'–13', as indicated by phantom lines in FIG. 17. In this case, obviously the problem of damaging contact between the respective unit head substrates will become more remarkable.

SUMMARY OF THE INVENTION

It is, therefore, an object of the present invention to provide a divisional-type thermal printhead which can be effectively prevented or restrained from warping or bending under a pressing force applied by a platen, thereby preventing damaging end-to-end contact between each two adjacent unit head substrates.

According to one aspect of the present invention, there is provided a divisional-type thermal printhead comprising: an elongate support member; a row of unit head substrates fixed on the support member, each of the unit head substrates carrying a resistor line extending longitudinally of the support member; and a pair of boundary spaces formed between each adjacent two of the unit head substrates, the pair of boundary spaces flaring in opposite directions from the resistor line of said each unit head substrate; wherein a resin spacer is formed in each of the boundary spaces in bonding contact with said each two adjacent unit head substrates.

The resin spacer may completely occupy each boundary space. Alternatively, the resin spacer may partially occupy the boundary space.

In a preferred embodiment, the printhead further comprises a first row of presser covers mounted to the support member along one longitudinal side thereof, and a boundary between each adjacent two of the first row presser covers is made to deviate from the pair of boundary spaces between each two adjacent unit head substrates longitudinally of the support member.

The printhead may additionally comprise a second row of presser covers mounted to the support member along the other longitudinal side thereof. In this case, again, a boundary between each adjacent two of the second row presser covers is preferably made to deviate, longitudinally of the support member, from the pair of boundary spaces between each two adjacent unit head substrates as well as from the boundary between each adjacent two of the first row presser covers.

According to another aspect of the present invention, there is provided a divisional-type thermal printhead comprising: an elongate support member; a row of unit head substrates fixed on the support member, each of the unit head substrates carrying a resistor line extending longitudinally of the support member; a first row of presser covers mounted to the support member along one longitudinal side thereof; and a second row of presser covers mounted to the support member along the other longitudinal side thereof, wherein a boundary between each adjacent two of the first row presser covers deviates from a boundary between each adjacent two of the second row presser covers longitudinally of the support member.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
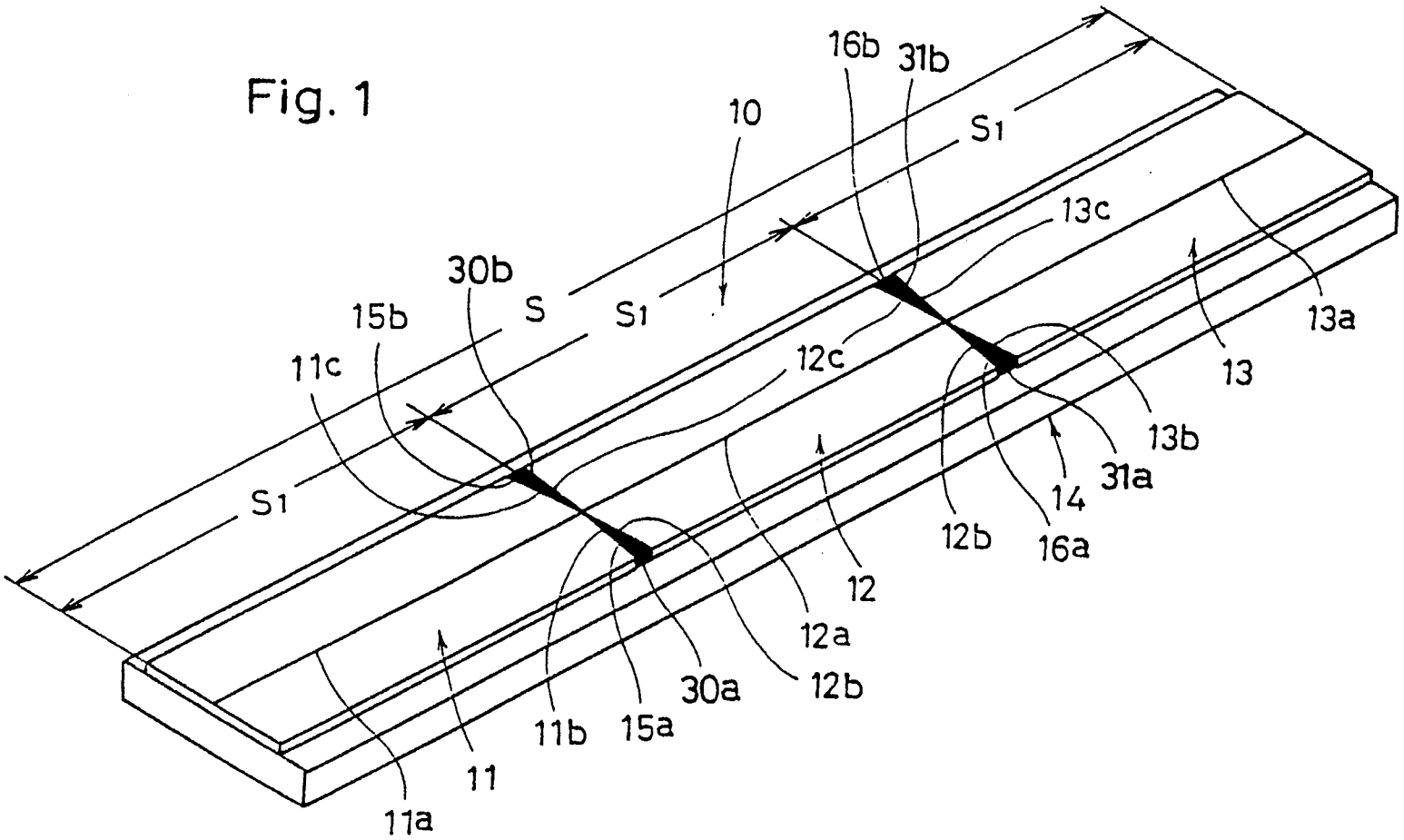
FIG. 1 is a perspective view showing a divisional-type thermal printhead according to the present invention with a presser cover assembly removed.

Referring first to FIGS. 1 to 4 of the accompanying drawings, there is shown a divisional-type thermal printhead according to the present invention with a presser cover assembly removed. The printhead, generally designated by reference numeral 10, comprises a plurality of unit head substrates 11, 12, 13 (three in the illustrated embodiment) arranged in series commonly on an elongate metal support member 14. The respective unit substrates may be made of an insulating material such as ceramic, whereas the support member 14 may be made of aluminum for example.

Each of the unit substrates 11–13 carries a resistor line 11*a*, 12*a*, 13*a* extending longitudinally of the support member 14 to provide a line of heating dots. The unit substrate has a unit printing width S1, and the printhead 10 as a whole provides an overall printing width S. The unit substrate may be bonded to the support member 14 by a layer of adhesive (not shown).

The inner end of the left-hand unit substrate 11 in FIG. 1 is formed with a pair of boundary edges 11*b*, 11*c* which extend from the corresponding resistor line 11*a*, and are inclined in opposite directions. Similarly, each end of the central unit substrate 12 is formed with a pair of boundary edges 12*b*, 12*c* which extend from the corresponding resistor line 12*a* and are inclined in opposite direction. Further, similarly, the inner end of the right-hand unit substrate 13 is formed with a pair of boundary edges 13*b*, 13*c* which extend from the corresponding resistor line 11*a*, and are inclined in opposite directions. As a result, a pair of V-shaped boundary spaces 15*a*, 15*b* are formed between the left-hand and central unit substrates 11, 12, whereas another pair of V-shaped boundary spaces 16*a*, 16*b* are formed between the central and right-hand unit substrates 12, 13.

Figure 2:
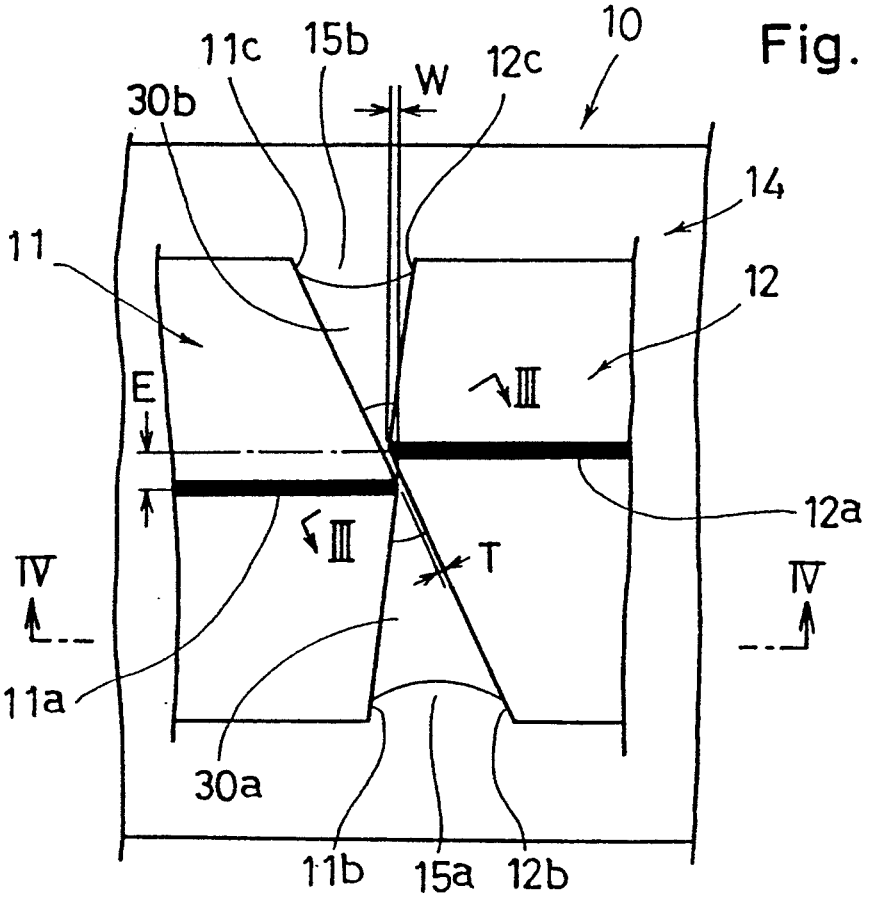
FIG. 2 is an enlarged fragmentary plan view showing a principal portion of the same printhead.
Figure 3:
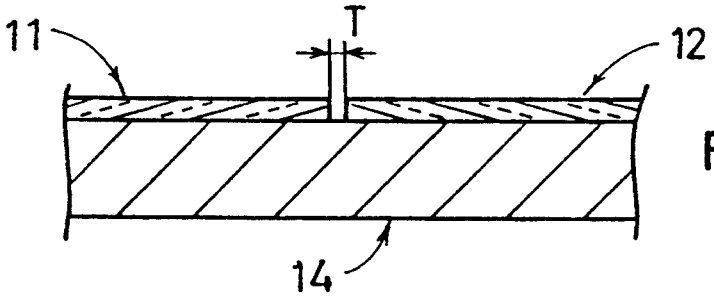
FIG. 3 is a sectional view taken along lines III—III in FIG. 2.

As shown in FIG. 2, the respective resistor lines 11*a*–13*a* are displaced transversely from each other by an amount E. As a result, the respective unit substrates 11–13 can be brought toward each other to make each two adjacent resistor lines overlap each other by an amount W while still maintaining a minimum clearance T (see also FIG. 3) of the micrometer order between the adjacent resistor lines.

Figure 4:
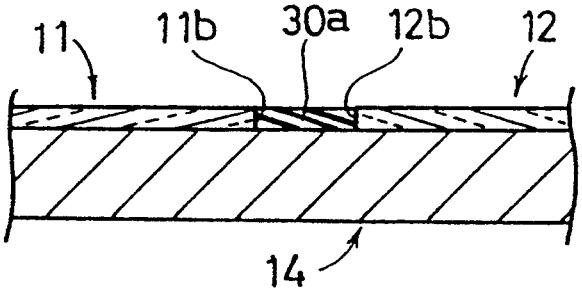
FIG. 4 is a sectional view taken along lines IV—IV in FIG. 2.

According to the present invention, resin spacers 30*a*, 30*b*, 31*a*, 31*b* are formed in situ in the respective V-shaped spaces 15*a*, 15*b*, 16*a*, 16*b* in bonding contact with the corresponding inclined boundary edges 11*b*, 11*c*, 12*b*, 12*c*, 13*b*, 13*c*, as shown in FIGS. 1, 2 and 4. The respective resin spacers may be made of a thermosetting resin such as epoxy.

Each of the resin spacers 30*a*, 30*b*, 31*a*, 31*b* may completely fill the corresponding one of the V-shaped spaces 15*a*, 15*b*, 16*a*, 16*b*, as shown in FIG. 1. Alternatively, the resin spacer may partially fill the V-shaped space, as shown in FIG. 2.

With the arrangement described above, the resin spacers 30*a*, 30*b*, 31*a*, 31*b* formed in the respective V-shaped spaces 15*a*, 15*b*, 16*a*, 16*b* between the unit head substrates 11–13 prevent or restrain the printhead 10 (namely, the support member 14) from warping downwardly even under a pressing force applied by a platen (not shown). Thus, it is possible to prevent or reduce a printing quality deterioration which would otherwise result from such warping of the support member 14. Further, due to the prevention or reduction of downward warping, the boundary edges 11*b*, 11*c*, 12*b*, 12*c*, 13*b*, 13*c* of the respective unit substrates 11–13 are rendered less likely to come into damaging contact with each other, thereby preventing formation of defects such as chipping of the unit substrates which are made of ceramic.

Figure 5:
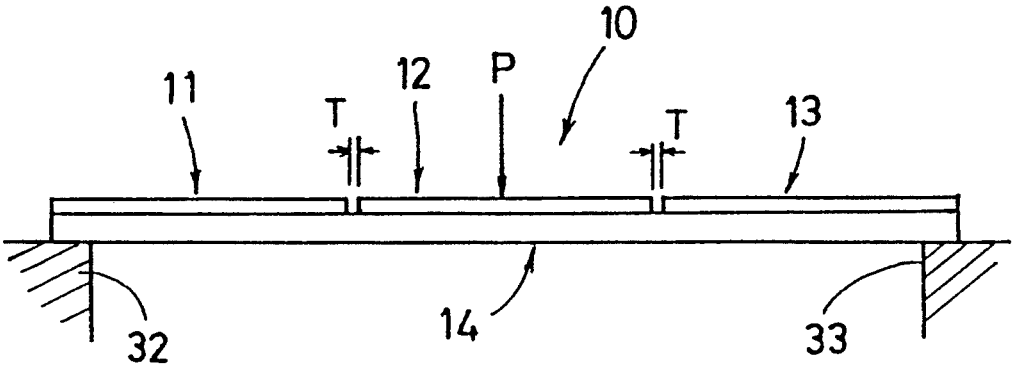
FIG. 5 is a schematic front view showing the same printhead under a warping test.

For experimentally confirming the advantages obtainable by the present invention, the printhead 10 was supported at both ends on support bases 32, 33, as shown in FIG. 5. Then, a downward load P of 5 kg and 15 kg, respectively, was applied generally at the center of the printhead for determining a variation of the minimum clearance T under the load application. The overall printing width S of the printhead 10 was set to be 92.6 cm in the experiment. For comparison, a similar experiment was also performed with respect to a prior art printhead which differed from the printhead of the present invention only in that no resin spacer is provided for each of the V-shaped spaces 15*a*, 15*b*, 16*a*, 16*b*.

The results of the above experiment are shown in Table 1 below. It should be understood that the units in Table 1 are in micrometers unless otherwise specified.

TABLE 1

| | p = 0 kg | p = 5 kg | p = 15 kg |
|---|---|---|---|
| T (Comparison) | 15.5 | 4.5 | 0.0 |
| T (Invention) | 15.4 | 15.4 | 13.8 |

From Table 1, it is appreciated that the clearance T between the respective unit substrates 11–13 of the inventive printhead is still 13.8 micrometers even under the 15 kg load, whereas the clearance between the respective unit substrates of the comparative (prior art) printhead reduces to zero (hence damaging contact between the unit substrates) under the same load. Thus, the effectiveness of the resin spacers 30*a*, 30*b*, 31*a*, 31*b* has been experimentally confirmed.

Figure 6:
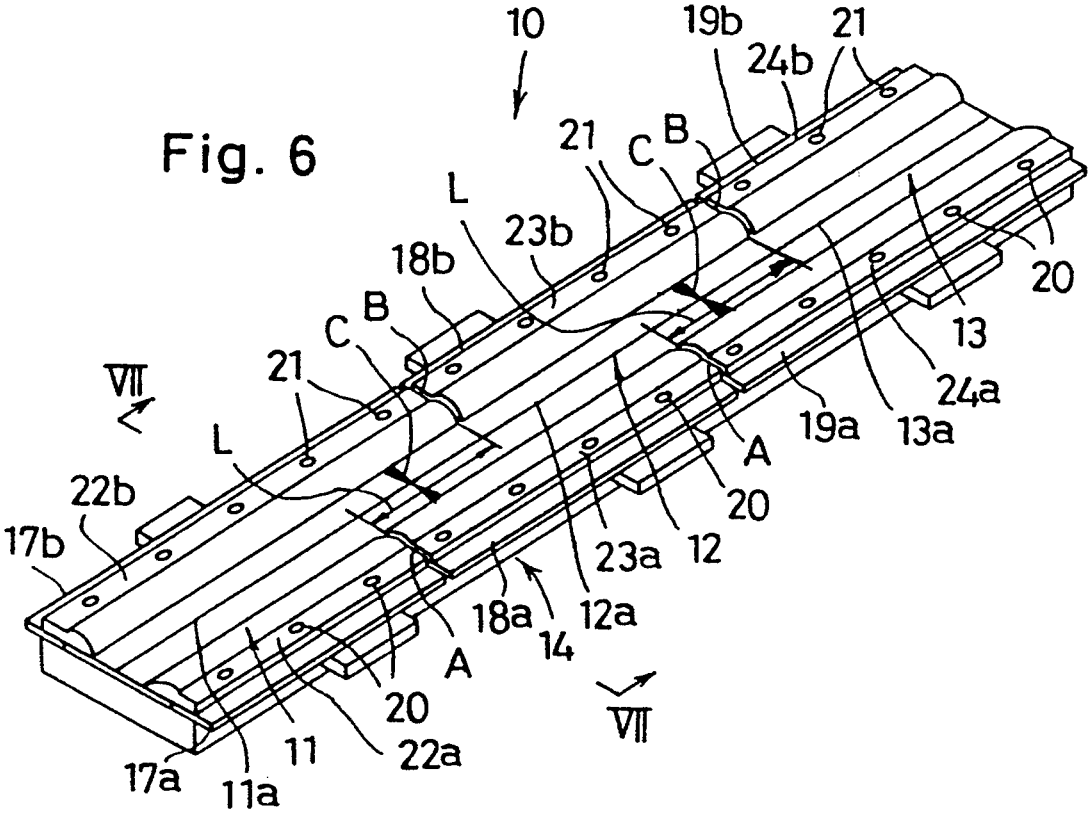
FIG. 6 is a perspective view showing the same printhead assembled with the presser cover assembly.
Figure 7:
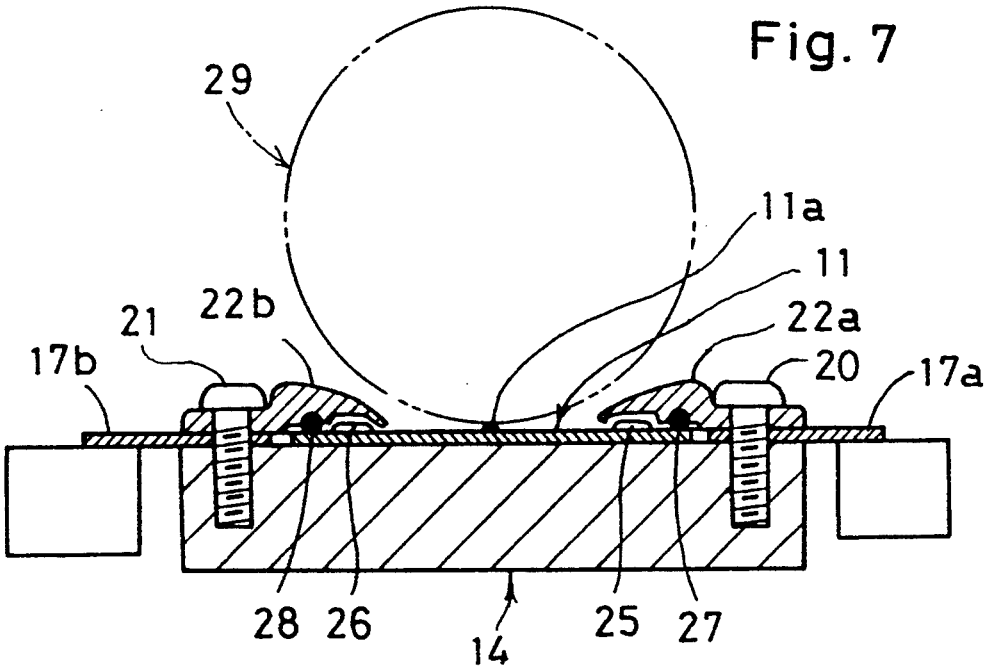
FIG. 7 is a sectional view taken along lines VII—VII in FIG. 6.
Figure 8:
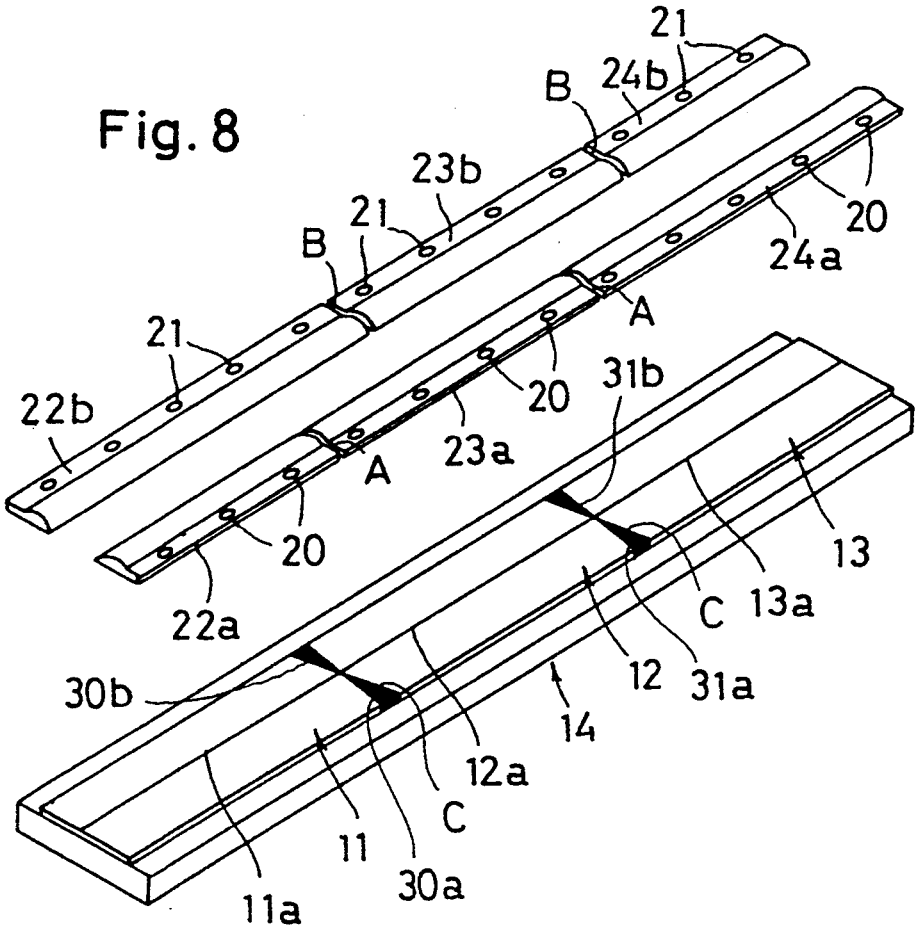
FIG. 8 is a perspective view showing the same printhead just before mounting the presser cover assembly.
Figure 9:
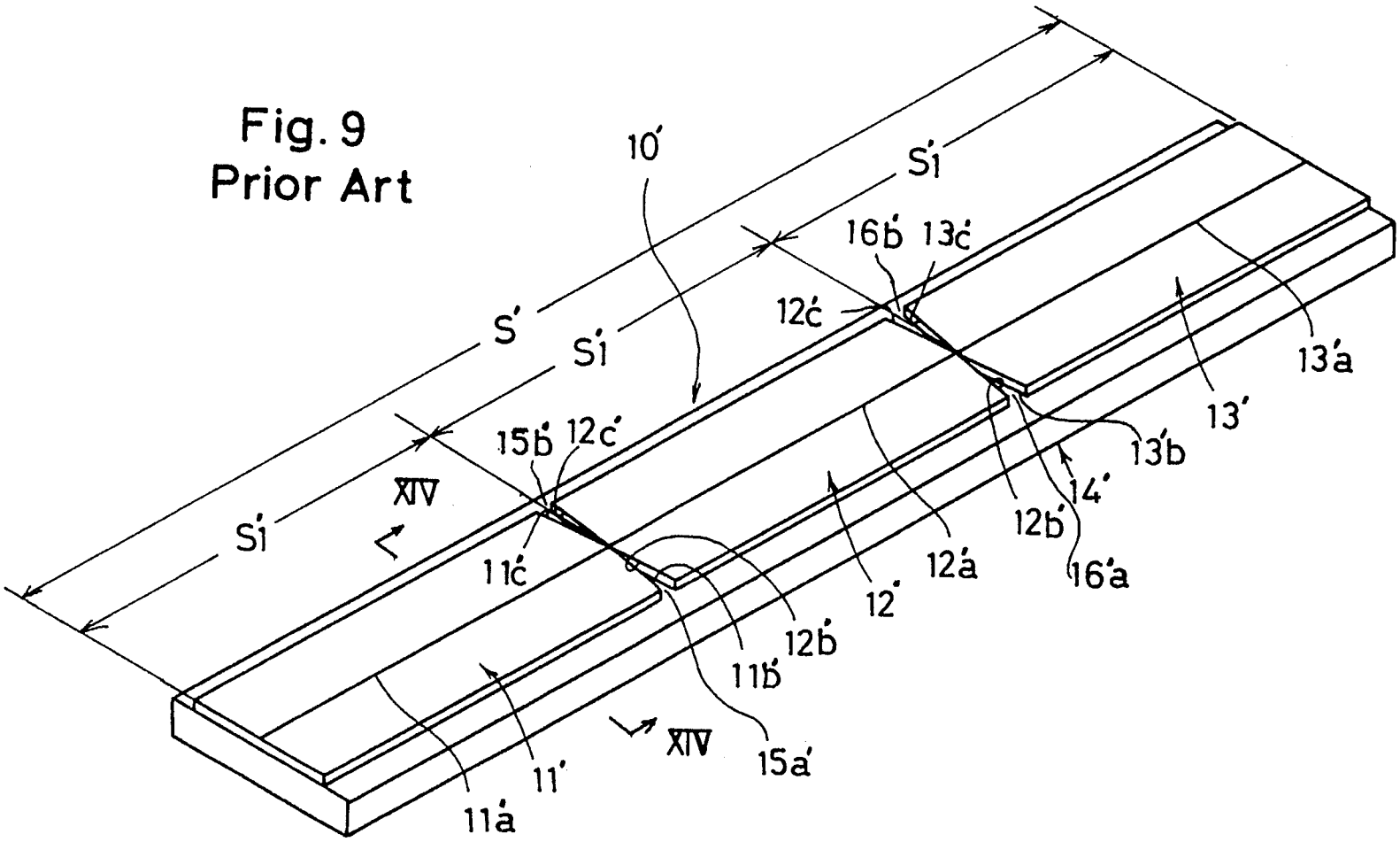
Fig. 9 Prior Art
FIG. 9 is a perspective view showing a prior art divisional-type thermal printhead with a presser cover assembly removed.
Figure 10:
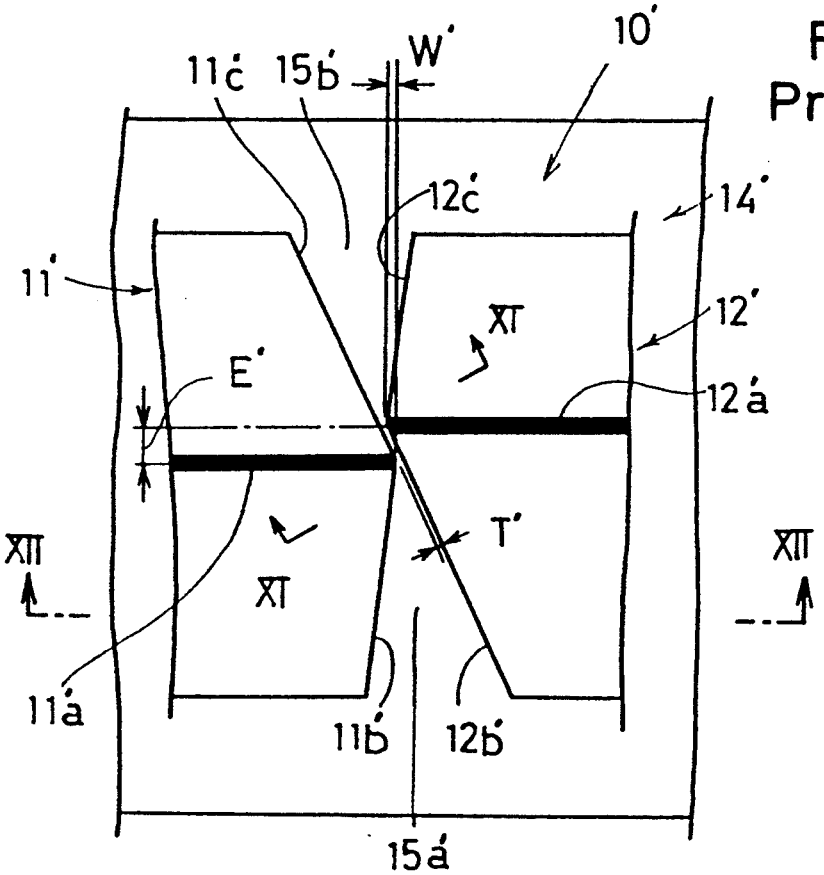
Fig. 10 Prior Art
FIG. 10 is an enlarged fragmentary plan view showing a principal portion of the prior art printhead.
Figure 11:
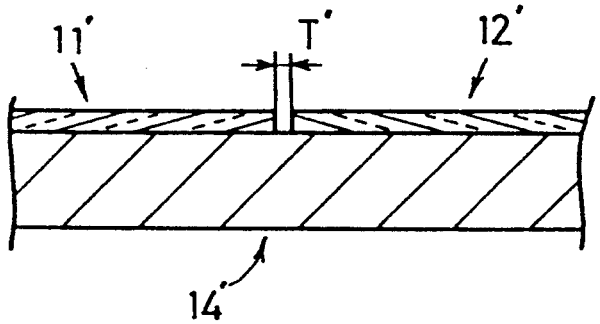
Fig. 11 Prior Art
FIG. 11 is a sectional view taken along lines XI—XI in FIG. 10.
Figure 12:
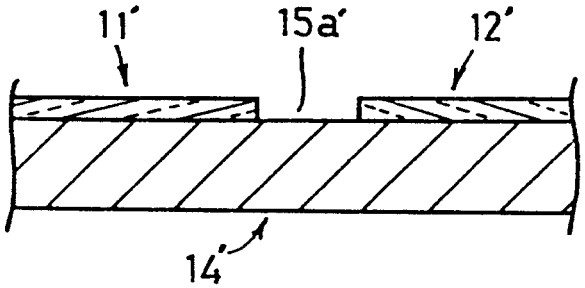
Fig. 12 Prior Art
FIG. 12 is a sectional view taken along lines XII—XII in FIG. 10.
Figure 13:
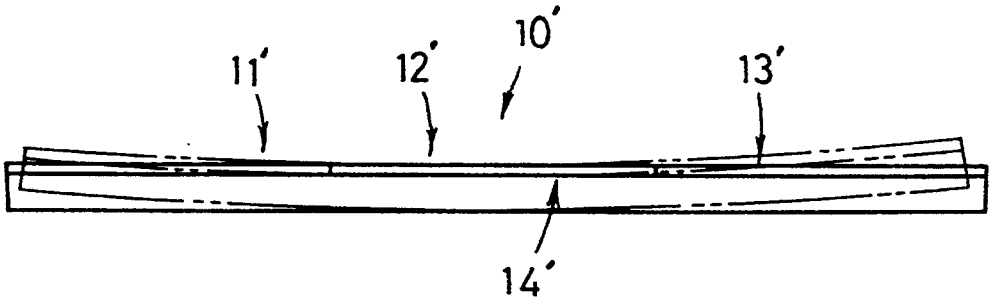
Fig. 13 Prior Art
FIG. 13 is a schematic front view showing how the prior art printhead warps under a downward load.
Figure 14:
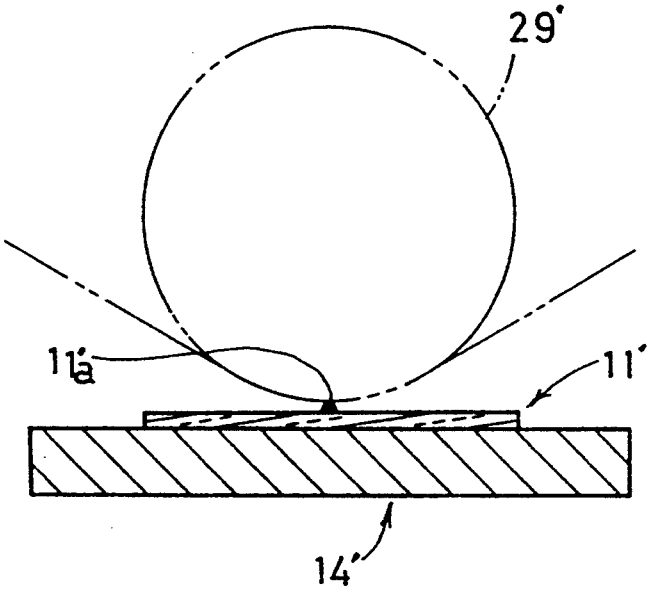
Fig. 14 Prior Art
FIG. 14 is a sectional view taken along lines XIV—XIV in FIG. 9.
Figure 15:
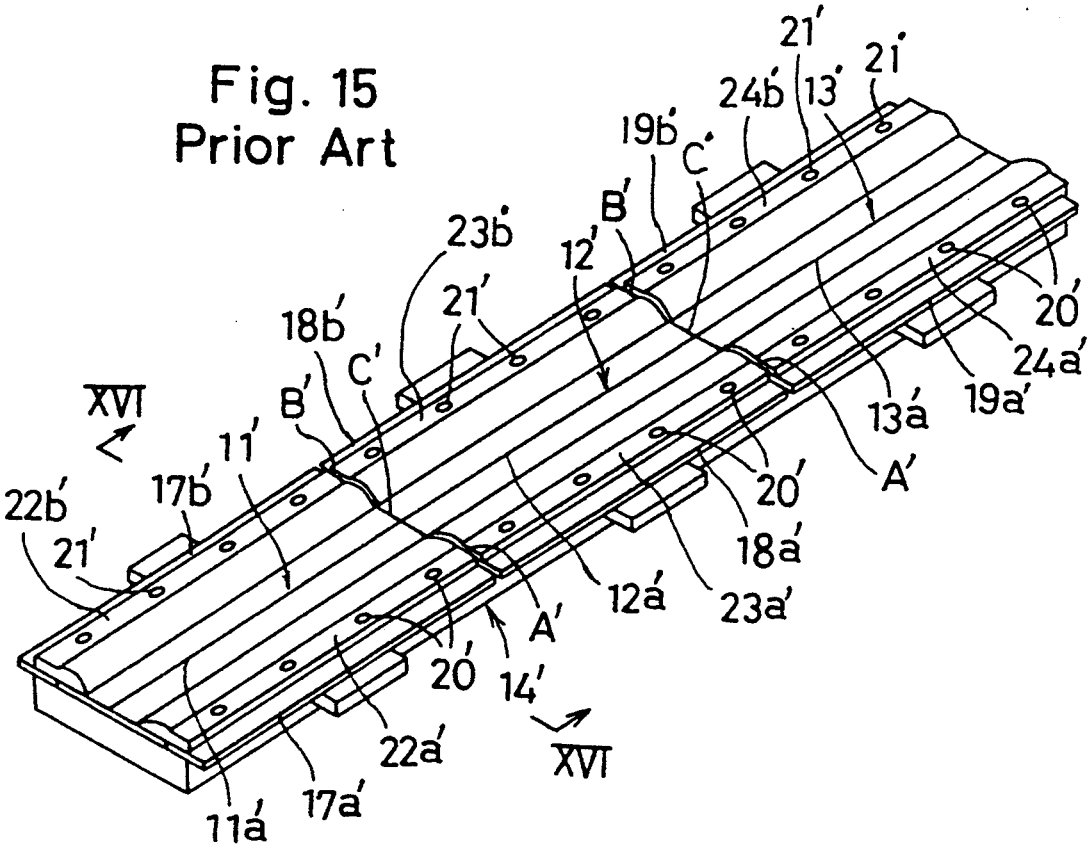
Fig. 15 Prior Art
FIG. 15 is a perspective view showing the same prior art printhead assembled with the presser cover assembly.
Figure 16:
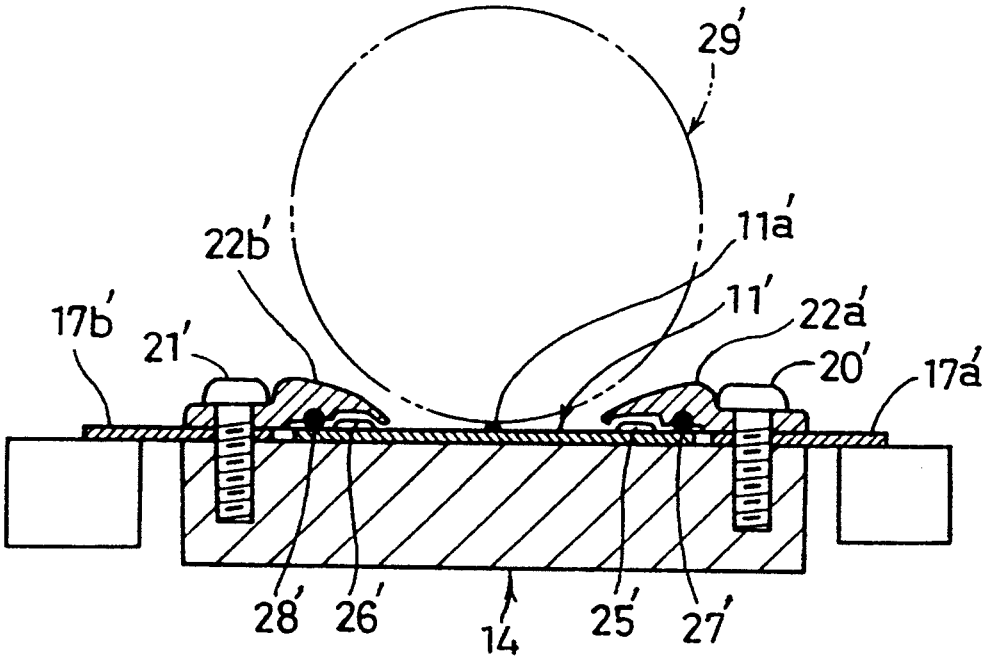
Fig. 16 Prior Art
FIG. 16 is a sectional view taken along lines XVI—XVI in FIG. 15.

FIGS. 6 to 8 show the same printhead 10 with a presser cover assembly.

More specifically, in actual assembly, the unit head substrates 11–13 are flanked by respective pairs of connector circuit boards 17*a*, 17*b*, 18*a*, 18*b*, 19*a*, 19*b*. The pairs of connector circuit boards are held in place on the support member 14 by respective pairs of presser covers 22*a*, 22*b*, 23*a*, 23*b*, 24*a*, 24*b* which are in turn fixed to the support member 14 by respective screws 20, 21. Though not specifically shown, each of the connector circuit boards has a flexible film projecting beyond a backing plate to partially overlap the corresponding unit head substrate.

The respective pairs of presser covers 22*a*, 22*b*, 23*a*, 23*b*, 24*a*, 24*b* protect arrays of drive ICs 25, 26 arranged on both sides of the resistor lines 11*a*, 12*a*, 13*a*. Further, the pairs of presser covers also press the respective pairs of connector circuit boards 17*a*, 17*b*, 18*a*, 18*b*, 19*a*, 19*b* (specifically, the flexible films thereof) into intimate contact with the unit head substrates 11–13 via respective rubber rods 27, 28.

Preferably, the successive presser covers 22*a*, 23*a*, 24*a* and 22*b*, 23*b*, 24*b* are made to differ in length from each other so that the boundaries A, B between the successive presser covers deviate from the corresponding boundaries C between the respective unit head substrates 11–13 provided by the respective pairs of resin spacers 30*a*, 30*b*, 31*a*, 31*b* (see FIG. 8). Further advantageously, the boundaries A between the successive presser covers 22*a*, 23*a*, 24*a* on one longitudinal side of the printhead deviate from the corresponding boundaries B between the successive presser covers 22*b*, 23*b*, 24*b* on the other longitudinal side of the printhead by an amount L (see FIG. 6) and in the opposite directions from the corresponding boundaries C between the unit head substrates.

The printhead 10 with the thus configured presser cover assembly has the following advantages in addition to those obtainable by the provision of the resin spacers 30*a*, 30*b*, 31*a*, 31*b*.

First, a series of mechanically weaker points at the respective boundaries A between the successive presser covers 22*a*, 23*a*, 24*a* on the one side of the printhead 10 are reinforced by the successive presser covers 22*b*, 23*b*, 24*b* on the other side of the printhead, and vice versa. Thus, the printhead as a whole is effectively prevented or restrained from warping downwardly even when a relatively large pressing load is applied by a platen 29.

Figure 17:
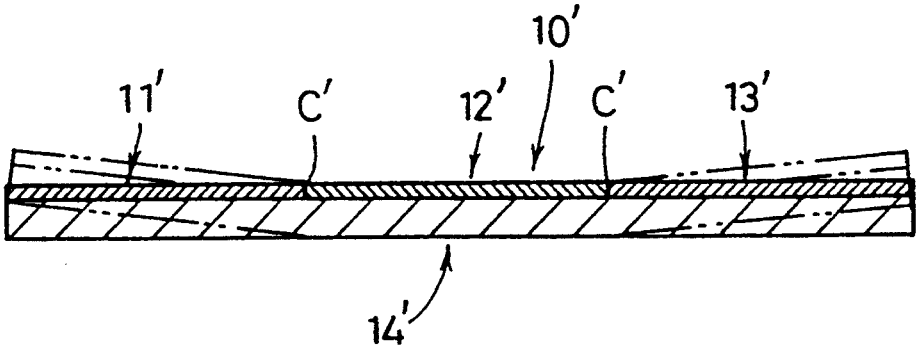
Fig. 17 Prior Art
FIG. 17 is a front view showing how the prior art printhead with the presser cover assembly bends under a downward load.
Figure 18:
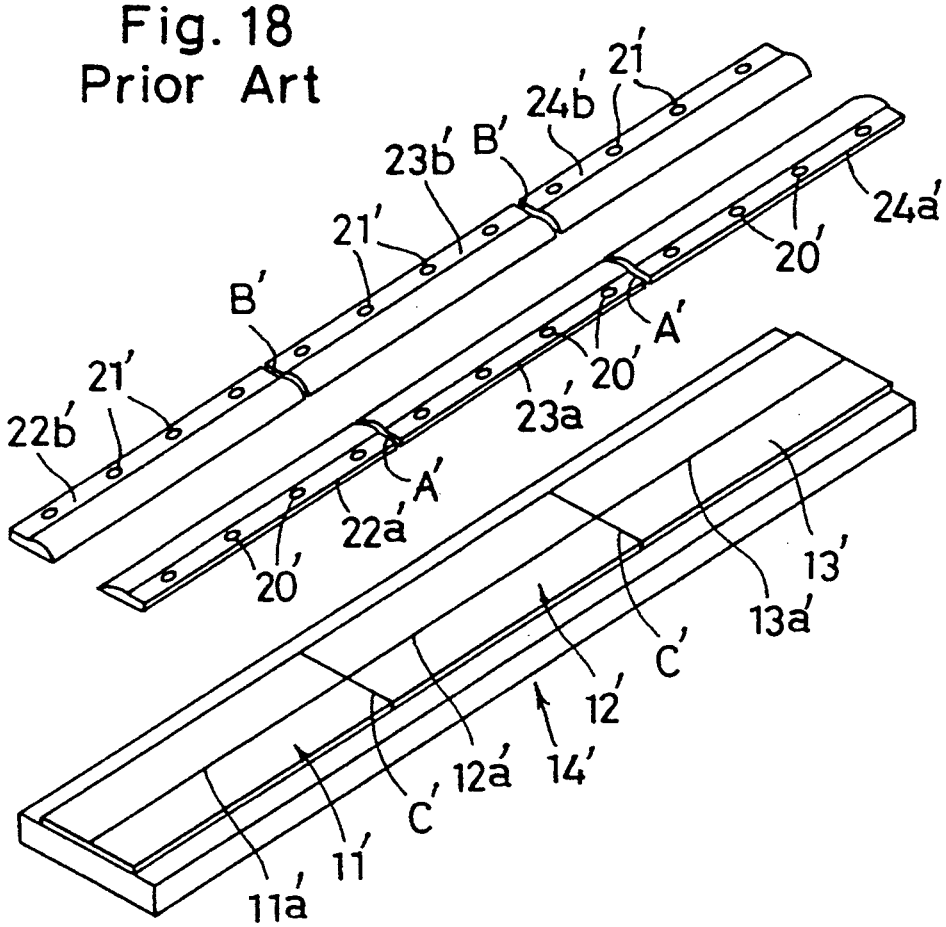
Fig. 18 Prior Art
FIG. 18 is a perspective view showing the prior art printhead just before mounting the presser cover assembly.

Secondly, the boundaries A, B between the successive presser covers 22*a*, 23*a*, 24*a* and 22*b*, 23*b*, 24*b* do not coincide with the boundaries C between the respective unit head substrates 11–13. Thus, it is possible to prevent the printhead 10 from bending abruptly at the boundaries C between the unit head substrates (refer to FIG. 17).

For confirming the advantages obtainable by the present invention, the same tests as shown in FIG. 5 was also performed with respect to the printhead 10 assembled with the presser cover assembly wherein the three different kinds of boundaries A, B, C were made to positionally deviate from each other. However, the resin spacers 30*a*, 30*b*, 31*a*, 31*b* were purposely omitted for clarifying the contribution to the warping or bending prevention provided by the specifically configured presser cover assembly alone.

The results of the above experiment are shown in Table 2 below. Again, the units in Table 2 are in micrometers unless otherwise specified. For comparison, Table 2 also shows the test results (the same results as shown in Table 1) obtained by the prior art printhead.

TABLE 2

| | p = 0 kg | p = 5 kg | p = 15 kg |
|---|---|---|---|
| T (Comparison) | 15.5 | 4.5 | 0.0 |
| T (Invention) | 15.5 | 13.0 | 10.4 |

Table 2 clearly indicates that the specifically configured presser cover assembly (see FIGS. 6–8) alone is sufficient for preventing or restraining the warping or bending of the printhead. Obviously, the warping prevention provided by the resin spacers 30*a*, 30*b*, 31*a*, 31*b* is additive, so that a greater warping prevention is obtainable by the combination of the specially configured presser cover assembly and the resin spacers.

The present invention being thus described, it is obvious that the same may be modified in many ways. For instance, the successive presser covers 22*a*, 23*a*, 24*a* or 22*b*, 23*b*, 24*b* on either side of the printhead 10 may be omitted together with their associated components. Thus, it should be understood that all such modifications as would be obvious to those skilled in the art intended to be included in the scope of the present invention as defined in the appended claims.

We claim:

1. A divisional-type thermal printhead comprising:

an elongate support member;

a row of unit head substrates fixed on the support member, each of the unit head substrates carrying a resistor line extending longitudinally of the support member; and a pair of boundary spaces formed between each adjacent two of the unit head substrates, the pair of boundary spaces flaring in opposite directions from the resistor line of each of said unit head substrates of the adjacent two of the unit head substrates;

wherein a resin spacer is formed in each of the boundary spaces in bonding contact with said each adjacent two of the unit head substrates.

2. The printhead according to claim 1, wherein the resin spacer completely occupies said each of the boundary spaces.

3. The printhead according to claim 1, wherein the resin spacer partially occupies said each of the boundary spaces.

4. The printhead according to claim 1, further comprising a first row of presser covers mounted to the support member along one longitudinal edge thereof and covering the row of unit head substrates, a boundary between each adjacent two of the first row presser covers deviating from the pair of boundary spaces between said each adjacent two of the unit head substrates in a direction extending longitudinally of the support member.

5. The printhead according to claim 4, further comprising a second row of presser covers mounted to the support member along another longitudinal edge thereof and covering the row of unit head substrates, a boundary between each adjacent two of the second row presser covers deviating from the pair of boundary spaces between said each adjacent two of the unit head substrates in a direction extending longitudinally of the support member.

6. The printhead according to claim 5, wherein the boundary between said each adjacent two of the second row presser covers also deviates from the boundary between said each adjacent two of the first row presser covers in a direction extending longitudinally of the support member.

7. The printhead according to claim 1, wherein the resin spacer is made of a thermosetting resin.

8. A divisional-type thermal printhead comprising:

an elongate support member;

a row of unit head substrates fixed on the support member, each of the unit head substrates carrying a resistor line extending longitudinally of the support member;

a first row of presser covers mounted to the support member along one longitudinal edge thereof; and a second row of presser covers mounted to the support member along another longitudinal edge thereof, wherein the first and second rows of presser covers cover said row of unit head substrates, wherein a boundary between each adjacent two of the first row presser covers deviates from a boundary between each adjacent two of the second row presser covers in a direction extending longitudinally of the support member.

9. The printhead according to claim 8, the boundary between said each adjacent two of the first row presser covers as well as the boundary between said each adjacent two of the second row presser covers deviates from a boundary between each adjacent two of the unit head substrates longitudinally of the support member.

* * * * *